United States Patent [19]

Vermonet

[11] 4,361,969

[45] Dec. 7, 1982

[54] SHOE WITH PNEUMATIC CUSHIONING CHAMBER

[75] Inventor: Christian Vermonet, Cholet, France

[73] Assignee: Societe a Responsabilite Limitee Technisynthese, Saint Pierre Montlimart, France

[21] Appl. No.: 217,177

[22] Filed: Dec. 16, 1980

[30] Foreign Application Priority Data

Dec. 28, 1979 [FR] France ..... 79 31937

[51] Int. Cl.[3] ..... A43B 7/14; A43B 13/20; A43B 21/26; A43B 19/00

[52] U.S. Cl. ..... 36/88; 36/29; 36/35 B; 36/71

[58] Field of Search ..... 36/29, 35 B, 3 R, 3 A, 36/3 B, 88, 71

[56] References Cited

U.S. PATENT DOCUMENTS

| | | | |
|---|---|---|---|
| 220,475 | 10/1879 | Hannaford | 36/35 B |
| 1,819,565 | 8/1931 | McBride | 36/35 B |
| 2,020,240 | 11/1935 | Cochran . | |
| 3,410,004 | 11/1968 | Finn | 36/71 |
| 3,469,576 | 9/1969 | Smith . | |
| 3,888,242 | 6/1975 | Harris et al. | 36/88 |

FOREIGN PATENT DOCUMENTS 1406610 6/1964 France .

*Primary Examiner*—Patrick D. Lawson
*Attorney, Agent, or Firm*—Young & Thompson

[57] ABSTRACT

A shoe, particularly a sport shoe, has a sole with a shallow recess therein that is closed by a lining impervious to air. The upper of the shoe also has air chambers therein, in surrounding relationship to the heel, these latter chambers also communicating with the air chamber of the sole. A crescent-shaped piece at the rear of the upper protects the Achilles' tendon of the wearer and is hollow and flexible and communicates with the air chamber in the shoe sole. As a result, the air chambers can deform substantially so as to absorb shock and protect the rear of the foot of the wearer, at the same time that the pressure in the various chambers does not greatly change.

4 Claims, 3 Drawing Figures

SHOE WITH PNEUMATIC CUSHIONING CHAMBER

It is already known, for example from French Pats. Nos. 317,846 and 341,490, to provide shoes whose sole comprises one or more air chambers which may be inflated by means of a valve. These soles have as their principal object to absorb, by pneumatic effect, the shock of the heel against the ground in the course of walking or running.

However, a problem arises as to the volume of these chambers and their deformability, which must be limited so as to preserve sufficient stability to support the foot of the wearer. This means that, in order for the air chamber to fulfill its role as energy absorber, the air pressure inside the chamber must be high and will increase rapidly for even a small compression of the chamber; whereas the comfort of the wearer requires that the energy be absorbed by a larger deformation with substantially constant pressure.

It is also been proposed, in French Pat. No. 1,406,610, to provide the internal walls of ski boots with one or more inflatable chambers. The purpose of these inflatable chambers is to obtain gripping of the foot with uniform distribution of the pressure between the foot and the boot. Such chambers are principally useful in high-top shoes in which the pressure exerted by the laces to maintain the shoe tight about the ankle, is quite high so as to avoid risk of accidents at this level.

It has also been proposed, to ensure good gripping of the heel bone, to provide an elastic band surrounding the ankle and passing behind the Achilles' tendon. The elasticity of the rear part of the top is thus ensured so as to permit the putting on of the boot while at the same time avoiding gapping of this part during flexure of the ankle. However, this continuous pressure can prove to be troublesome in use and increases as the foot is extended.

It has therefore been for a long time the practice to cut out in a crescent shape the top rear portion of the upper above the heel bone and to replace it with a more flexible material which will avoid bruising the Achilles' tendon.

Careful studies have shown that all these expedients have drawbacks and inconveniences and that in particular it has been desirable to use a combination of their principles of action to arrive at a desirable maintenance of the foot in the shoe. Moreover, it has proven to be necessary to ensure better encasing of the foot in the rear portion of the shoe at the time of the collapse of the pneumatic chambers while reducing the pressure exerted on the Achilles' tendon by the elastic bridle or the rear part of the top during the extension of the foot. The problem to be solved was somehow to increase the volume of the air chambers, supporting the foot in the sole, so as to give them a greater volumetric deformation with a small variation in unit pressure, to make the enclosing surface of the flexible crescent follow the movement of the Achilles' tendon to provide yielding pressure distributed over a large surface above the heel bone and which varies only slightly in intensity between the bent and extended positions of the ankle in which the Achilles' tendon moves toward or away from the crescent and to house laterally the heel over a substantial height, approximately to the right of the arch of the sole of the foot with increased pressure so that the casing under pressure will alleviate the deformability of the pneumatic chambers of the shoe sole.

These results are achieved with a shoe according to the invention comprising a sole with pneumatic chambers disposed at least partially above the bearing surface of the heel of the foot and an upper provided with air chambers, this shoe being characterized in that the deformable air chambers of the upper at least toward the interior of the shoe are provided in the portions housing the rear part of the foot and are in communication with the pneumatic chamber or chambers of the sole.

According to another characteristic, the deformable air chambers are provided in the flanks of the upper which laterally encase the heel.

According to still another characteristic, the deformable air chambers of the upper are formed by a clearance provided between at least one portion of the flanks of the upper and its lining, both being of a material impervious to air.

According to another characteristic the portion comprising the flexible crescent protecting the Achilles' tendon comprises also an air chamber of which at least the wall comprising the inner surface of the shoe is deformable, this chamber being also in communication with the air chamber or chambers of the sole.

Preferably the system of air chambers may be inflated or deflated by means of a valve of known type, preferably a ball valve.

The present invention is principally applicable to sport shoes, so-called low-cuts for walking, running, tennis, basketball and the like.

Other characteristics and advantages of the present invention will become apparent from a reading of the detailed description of an embodiment given hereafter with respect to the accompanying drawing, in which.

Figure 1:
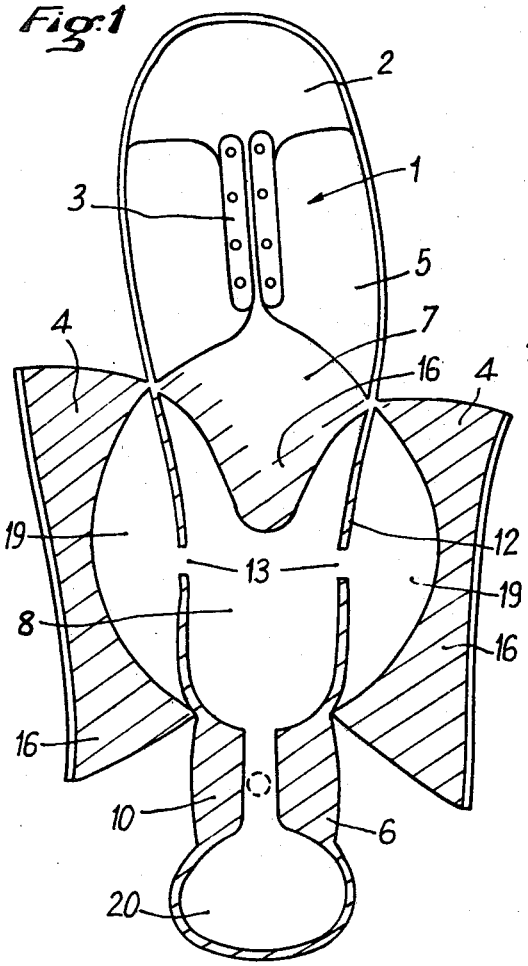
Fig. 1 is a schematic view with the upper flattened out, of a shoe according to the invention.
Figure 3:
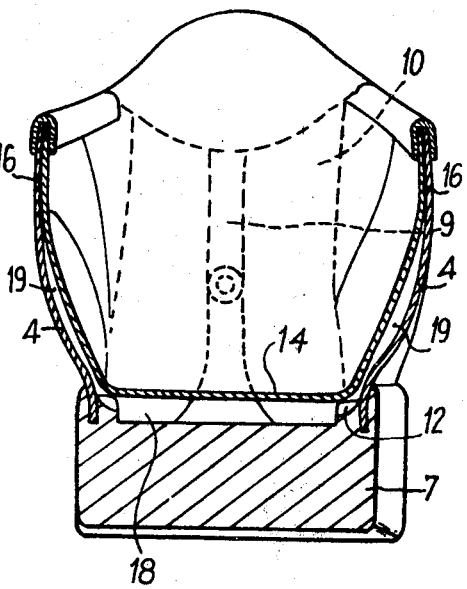
Fig. 3 is a view thereof on the line III-III of Fig. 2.
Figure 2:
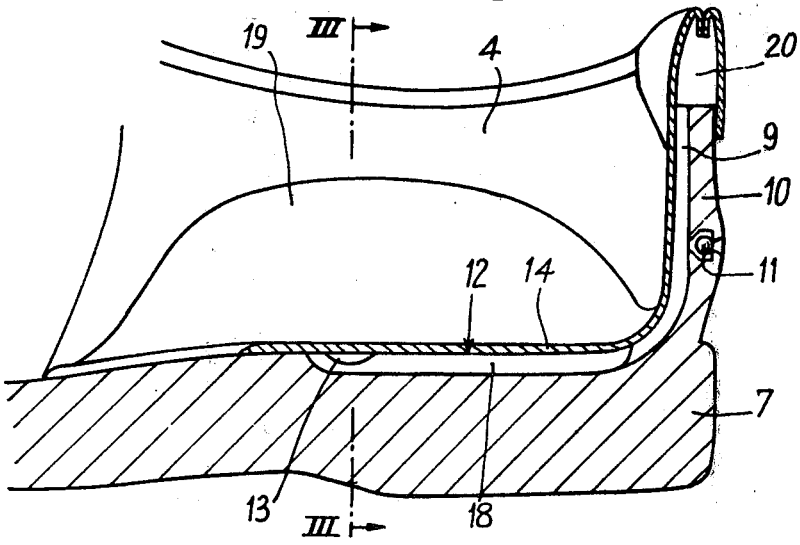
Fig. 2 is a longitudinal cross-sectional view of the rear portion of the shoe.

In the drawing, reference numeral 1 designates the forward part of the shoe with its toe cap 2 and its eyelet strips 3. In Fig. 1, there are shown the flanks 4 of the upper 5 formed of a material which is impervious to air and the rear portion 6 of the upper, cut and bent into the plane of the top of the shoe sole. Reference numeral 7 designates the body of the sole which may be polyurethane foam.

According to the embodiment illustrated by way of example, the upper surface of the sole in the vicinity of the heel has a shallow recess 8 which is extended by a channel 9 that extends up along the axis of the heel reinforcement 10. Intermediate its length, channel 9 is provided with a ball valve 11 of known type. In the disclosed embodiment, the sole 7 and heel reinforcement 10 are molded and the edges of the upper 5 are molded into the molded material according to known molding techniques. The recess 8 terminates in a ledge 12 that opens inwardly with respect to the flanks 4 of the heel, these ledges being interrupted by a notch 13.

A lining 14 in a material impermeable to air is then placed in the rear portion of the shoe and cemented and vulcanized along the surfaces 15 that are crosshatched in Fig. 1, these surfaces corresponding to the internal surfaces of the flanks 4, of the heel reinforcement on the outside of channel 16, on the ledges 12 and on the sole in front of recess 8. The lining 14 is turned over to the rear at 17 and cemented and vulcanized on the edge of the outside surface of the heel reinforcement that constitute the protective crescent for the Achilles' tendon.

There is thus provided a chamber 18 under the heel two chambers 19 on the flanks 4 and a balloon 20 to the right of the protector of the Achilles' tendon. During inflation under moderate pressure, these chambers deform toward the interior without however opposing the introduction of the foot, the communication between the chambers 19 and 20 taking place without compression exerted on the chamber 18. When the foot is engaged it is slightly compressed by the balloons constituted by chambers 19 and 20 in their inflated state. If the pressure is exerted by the heel on chamber 18 the reduction in volume of this chamber is translated into an increase in pressure in chambers 19 and 20; but this variation of pressure is much smaller than it would be if chamber 18 were isolated and it acts on chambers 19 and 20 so as better to secure the upper to the foot.

The embodiment described above by way of example can be subjected to numerous modifications without departing from the scope of the appended claims.

What is claimed is:

1. A shoe comprising an upper and a sole, and in that portion of the sole on which the heel of the wearer bears, a chamber which is bounded on the interior of the shoe by a flexible wall, there being chambers in those portions of the upper that encase the rear of the foot of the wearer, these latter chambers also being bounded by flexible walls on the interior of the shoe, passageways of reduced cross section through which said chamber in the sole communicates with said chambers in the upper, and means to inflate said chambers.

2. A shoe as claimed in claim 1, the chambers in the upper being disposed on either side of the heel of the wearer.

3. A shoe as claimed in claim 2, and a hollow crescent-shaped chamber situated at the top rear of the upper and at the level of the Achilles tendon of the wearer, the last-named chamber being bounded inwardly by a flexible wall, the crescent-shaped chamber and the chamber beneath the heel of the wearer communicating with each other.

4. A shoe comprising an upper and a sole, and in that portion of the sole on which the heel of the wearer bears, a chamber which is bounded on the interior of the shoe by a flexible wall, means defining a hollow crescent-shaped chamber at the top rear of the upper and at the level of the Achilles tendon of the wearer, the last-named chamber being bounded inwardly by a flexible wall, the crescent-shaped chamber and the chamber beneath the heel of the wearer communicating with each other, and means to inflate said chambers.

* * * * *